US007866112B2

(12) United States Patent
Edmondson

(10) Patent No.: US 7,866,112 B2
(45) Date of Patent: Jan. 11, 2011

(54) SLOTTED METAL TRUSS AND JOIST WITH SUPPLEMENTAL FLANGES

(76) Inventor: Dennis Edmondson, P.O. Box 244, Marysville, WA (US) 98270

( * ) Notice: Subject to any disclaimer, the term of this patent is extended or adjusted under 35 U.S.C. 154(b) by 467 days.

(21) Appl. No.: 11/555,150

(22) Filed: Oct. 31, 2006

(65) Prior Publication Data

US 2007/0056245 A1 Mar. 15, 2007

Related U.S. Application Data

(63) Continuation-in-part of application No. 10/937,644, filed on Sep. 9, 2004, now Pat. No. 7,743,578.

(51) Int. Cl.
*E04B 1/18* (2006.01)
*E04B 1/19* (2006.01)

(52) U.S. Cl. ..... 52/650.1; 52/646; 52/691; 52/633

(58) Field of Classification Search ..... 52/633, 52/634, 636, 643, 650.1, 646, 691
See application file for complete search history.

(56) References Cited

U.S. PATENT DOCUMENTS 1,656,810 A * 1/1928 Arnstein ..... 52/634
1,682,202 A * 8/1928 Vaugh ..... 52/636
1,850,118 A * 3/1932 Meyers ..... 52/223.6
1,994,716 A * 3/1935 Klemperer ..... 52/634
2,088,781 A * 8/1937 Folsom ..... 52/634
2,541,784 A * 2/1951 Shannon ..... 52/92.2
3,101,817 A * 8/1963 Radek ..... 52/241
3,146,864 A * 9/1964 Nystrom et al. ..... 52/93.2
3,352,070 A * 11/1967 Raynes ..... 52/22
3,511,000 A * 5/1970 Keuls ..... 52/126.4
3,845,601 A * 11/1974 Kostecky ..... 52/290
3,854,192 A * 12/1974 O'Konski ..... 228/135
3,908,328 A * 9/1975 Nelsson ..... 52/769
3,940,899 A * 3/1976 Balinski ..... 52/481.1
4,016,700 A * 4/1977 Blomstedt ..... 52/481.1
4,047,355 A * 9/1977 Knorr ..... 52/481.1
4,288,958 A * 9/1981 Chalmers et al. ..... 52/478
4,342,177 A * 8/1982 Smith ..... 52/93.1
4,353,192 A * 10/1982 Pearson et al. ..... 52/281
4,435,936 A * 3/1984 Rutkowski ..... 52/481.1
4,538,391 A * 9/1985 Skrabis et al. ..... 52/478
4,616,453 A * 10/1986 Sheppard et al. ..... 52/93.1
4,693,047 A * 9/1987 Menchetti ..... 52/664
4,720,957 A * 1/1988 Madray ..... 52/846
4,793,113 A * 12/1988 Bodnar ..... 52/481.1
4,809,476 A * 3/1989 Satchell ..... 52/241
4,854,096 A * 8/1989 Smolik ..... 52/241
4,866,899 A * 9/1989 Houser ..... 52/481.1
4,878,323 A * 11/1989 Nelson ..... 52/92.2
4,982,545 A * 1/1991 Stromback ..... 52/639
5,157,883 A * 10/1992 Meyer ..... 52/357
5,274,973 A * 1/1994 Liang ..... 52/243

(Continued)

*Primary Examiner*—Phi Dieu Tran A
(74) *Attorney, Agent, or Firm*—David L. Tingey

(57) ABSTRACT

A slotted channel with a supplemental flange as a building member has at least one supplemental flange extending from at least one slot in the member web or primary flanges yielding a building member with increased strength, both compressive (longitudinally) and in shear (transverse). The slotted member presents a reduced area through which heat or sound may be conducted and slots in which insulation is received, both increasing resistance to heat and sound transfer.

13 Claims, 10 Drawing Sheets

U.S. PATENT DOCUMENTS 5,457,927 A * 10/1995 Pellock et al. ..... 52/633
5,463,837 A * 11/1995 Dry ..... 52/639
5,527,625 A * 6/1996 Bodnar ..... 428/595
5,592,796 A * 1/1997 Landers ..... 52/241
5,596,859 A * 1/1997 Horton et al. ..... 52/481.1
5,771,653 A * 6/1998 Dolati et al. ..... 52/846
5,857,306 A * 1/1999 Pellock ..... 52/643
D423,325 S * 4/2000 Liss ..... D8/349
6,263,634 B1 * 7/2001 Bodnar et al. ..... 52/506.05
6,301,854 B1 * 10/2001 Daudet et al. ..... 52/650.1
6,418,694 B1 * 7/2002 Daudet et al. ..... 52/650.1
6,578,335 B2 * 6/2003 Poliquin ..... 52/481.2
6,691,478 B2 * 2/2004 Daudet et al. ..... 52/289
6,708,459 B2 * 3/2004 Bodnar ..... 52/356
6,754,999 B1 * 6/2004 Urbanczyk ..... 52/272
6,761,005 B1 * 7/2004 Daudet et al. ..... 52/272
6,843,035 B1 * 1/2005 Glynn ..... 52/573.1
6,907,695 B2 * 6/2005 Pierce ..... 52/66
7,168,219 B2 * 1/2007 Elderson ..... 52/667
7,231,746 B2 * 6/2007 Bodnar ..... 52/842
7,451,575 B2 * 11/2008 Hall et al. ..... 52/289
2002/0038533 A1 * 4/2002 Potter et al. ..... 52/634
2002/0134036 A1 * 9/2002 Daudet et al. ..... 52/289
2003/0014935 A1 * 1/2003 Bodnar ..... 52/481.1
2008/0295442 A1 * 12/2008 Moody et al. ..... 52/634

* cited by examiner

SLOTTED METAL TRUSS AND JOIST WITH SUPPLEMENTAL FLANGES

This application is a continuation in part of the inventor's application filed Sep. 9, 2004 now U.S. Pat. No. 7,743,578 under Ser. No. 10/937,644.

BACKGROUND

1. Field of the Invention

This invention relates to steel trusses and joists comprising parallel flanges extending orthogonally from web sides, and more particularly to a truss or a joist with at least one slot in the web or primary flanges and including supplemental flanges extending from slot sides.

2. Prior Art

Interior wall construction using horizontal channel beams as headers and footers and matching vertical studs received into the channel beams is well-known. Commonly, the studs are also channel-shaped and both are made of metal, typically cold formed metal and more typically steel. Similarly, metal buildings employ girts (sidewall bracing) and perlins (roof bracing). Roof rafters, headers, footers, beams, and joists and trusses comprised of a plurality of similar elongate components can also employ channel shaped members. All of these building components have in common that they are elongate and straight, including the truss comprising a plurality of elongate building components. For purposes of simplicity of description, they are collectively referred to as a "beam" unless otherwise indicated in the context. That is, for purposes herein, the description referencing a beam should be deemed to include and apply to each and all elongate building components, specifically including those listed and also including the elongate building components of which a truss is comprised. For purposes herein, reference may be made to metal or steel beam. These terms are not meant to be restrictive or limitations but are meant illustratively and generically to be synonymous and to include all materials from which such studs may be formed.

Of all modes of failure, buckling (Euler or local) is probably the most common and most catastrophic. That is, a structure may fail to support a load when a member in compression buckles, that is, moves laterally and shortens in length. A steel beam may be described for these purposes as a slender column where its length is much greater than its cross-section. Euler's equations show that there is a critical load for buckling of a slender column. With a large load exceeding the critical load, the least disturbance causes the column to bend sideways, as shown in the inserted diagram, which increases its bending moment. Because the bending moment increases with distance from a vertical axis, the slight bend quickly increases to an indefinitely large transverse displacement within the column; that is, it would buckle. This means that any buckling encourages further buckling and such failure becomes catastrophic.

The traditional steel beam construction comprises a pair of parallel flanges extending orthogonally from a web. Commonly the flange distal end bends inward slightly to increase the compressive stability converting the flat two-dimensional flange into a three dimensional structure. For these purposes, "compressive stability, strength or stress" means a reference value that measures the load a structure can sustain before it buckles or otherwise deforms and loses support for a load.

Such beams are very poor energy conservers. For example, for internal walls the metal beam acts as a thermal conduit and actually enhances thermal conductivity across the wall over wood and other materials. In metal buildings the beams (girts and perlins) are in direct metal-to-metal contact with the outside material sheeting and become conduits of heat on the outside sheeting to inside the building. Heat passes through the web, so one interested in reducing thermal conductive might consider removing material from the web to create slots in the web. To the extent such slots remove metal and thus reduce the thermal path, the beam is less conductive thermally. Also, such slots may receive insulation that further impede conductivity.

Similarly, a steel beam is a good acoustic conductor, which is detrimental in many applications. It has long been desired to reduce sound transmission through metal wall beams. As in thermal conductivity, re-shaping of a significant portion of the web or the flanges will reduce the acoustic conductivity of the beam and therefore the wall.

It is a primary object of the present invention to enhance the compressive stability, strength and bending resistance of a traditional steel beam. It is another object to reduce thermal conductivity and acoustical transmission, of the beam while enhancing the bending resistance and compressive stability and strength. To this end, it is a further object to introduce one or more slots in the beam web that interrupt conductivity across the web in combination with projections from the web at the slots additional to the primary flanges that enhance the load that a beam can support under bending and compression.

SUMMARY

These objects are achieved in a first embodiment in a beam having at least one supplemental flange of a substantial I areal dimension extending from a side of a corresponding slot in the web. These objects are also achieved in a second embodiment in a beam having a plurality of small holes punched in the beam leaving punched web or flange material projecting from the punched hole.

These supplemental flanges are formed by stamping out a flange in the web on three flange sides and then bending the supplemental flange away from the web on the fourth, uncut side, forming a slot in the web. The result then is a supplemental flange extending from the web at the slot edges. Typically, the supplemental flange usually extends normal to the web and parallel to the primary flanges extending from the web edges, although it can be angled from the web other than normal. The slot in the beam web presents a reduced web area through which heat or sound may be conducted.

The flange is formed as the slot is formed by cutting the web for the slot, dividing the intended slot area of the web into two equal side by side panels in the center and top and then folding the panels out from the plane of the web simultaneously forming the slot and a continuous supplemental flange. Alternatively, the slot area can be cut (stamped) with a U cut at the slot top and an inverted U at the slot bottom joined by a center cut between them. The top and bottom U panels are then folded outward to form horizontal supplemental flanges at the slot top and bottom and the side panels are folded out to form vertical supplemental flanges.

Rather than weaken the beam at the slot, the beam is in fact strengthened through a few mechanisms. First, the longitudinal extent of the web of a traditional beam presents a large vertical plane susceptible to local shear buckling under load that can lead to Euler bucking. Introducing slots having supplemental flanges into the web reduces that extent. That is, the Supplemental Flange Beam ("SFB") itself actually stiffens the web plane by creating smaller flat planes in the web plane than are present in standard steel studs thus increasing local shear buckling resistance.

The calculation discloses that for vertical loading the SFB provides better stability in buckling resistance due to the center of gravity being moved away from the plane of the web toward the opening of the channel section. This effect distributes the vertical load more uniformly over the SFB cross-sectional area; rather than mostly in the web as standard steel studs do; and thus forcing local buckling effects to require a higher vertical loading than standard steel studs can handle. The SFB also enhances resistance to Euler buckling (long column lateral deflection) by the new properties the supplemental flanges provide. In short, for the beam to bend at the slot, both the supplemental and primary flanges orthogonal to the web must also bend, but with the supplemental flanges, there is increased resistance to that bending.

The supplemental flange can be either continuous (fully encompassing the slot) or discontinuous (not completely encompassing the slot) although the former will provide for greater strength and structural stability than the latter. When all the original material in a traditional metal stud, or other beam, remains in the final SFB product, in the case of supplemental flanges extending from the full length of slot sides the SFB retains more than the total cross-sectional area of the traditional stud, which retains its support for compressive loads and provides additional rigidity that equates to better stability than traditional steel studs (other comparable beams). This is demonstrated in both the x-axis and y-axis bending calculations below.

Calculations confirm that adding the supplemental flange to the flange at the slot sides and ends not only fully offsets any loss of compressive strength caused by the slot but actually increases it over the unmodified beam without slots or supplemental flangesbeam. That is, the beam can sustain a greater compressive, or longitudinal, or bending load with slots and supplemental flanges than without them. The following calculation is typical:

The following calculation assumes a 16 gauge "C"-Section Channel, 6"×2½" (0.0598" wall thickness) beam.

The strength of a load-supporting column can be represented by the moment of inertia about the major axis, X-X, where buckling could occur first. When the moment reaches a high enough value, known as the Euler Buckling under load the column will buckle. This value is proportional to the moment of inertia, so the higher the moment of inertia, the more load the column will sustain before buckling.

The following equation calculates the moment of inertia ($in^4$) about the X-X axis for a channel cross-sectional area. The designated sections are as represented in FIG. 27.

$$I_{x-x} = 2(A_1 d_1^2) + 2(A_2 d_2^2) + 2\left(\frac{bh^3}{12}\right) + 2(A_3 d_3^2) + 2(A_4 d_4^2)$$

where h=0.0598 inch, the thickness of 16-gauge cold formed steel.

b=width of various sections. For the calculation of $I_{x-x}$, it will be determined from a central axis between the two widths, 2.50 inches, 1.00 inch, and perpendicular to the 0.375 inch dimension. For the calculation of $I_{y-y}$, it will be determined by an axis transverse to the two width dimensions, 2.50 inches, 1.00 inch, and parallel to 0.375 inch dimension.

d=distance (in) from the neutral axis to each centroid of an area "A", respectively.

The neutral axis is located at the centroid or center of gravity, CG, of the beam. It is determined using the equation, $$CG_{y-y}{}^{i} = yA_i/A_t$$

where $A_i$ represents the cross-sectional area of each area that makes up the total cross-sectional area, $A_t$.

TABLE 1

| Component | A, area ($in^2$) | y (in) | yA ($in^3$) |
|---|---|---|---|
| A-1 | 0.0598)(2.5()2 = 0.2990 | 1.25 | 0.374 |
| A-2 | (0.0598)(1)2 = 0.1196 | 0.5 | 0.0598 |
| A-3 | (0.0598)(2)(2) = 0.2392 | 0.0299 | 0.0072 |
| A-4 | (0.0598)(0.375)2 = 0.0449 | 2.5 | 0.1123 |
| Totals | $A_t$ = 0.7027 | | $yA_i$ = 0.5533 |

Using the values in the Table 1 to compute CG, $CG_{y-y}$=yA/A=(0.5533)/(0.7027)=0.7868 inch from the inside face of web. With this information the values for $I_{x-x}$ and $I_{y-y}$ of the supplemental flange beam can be calculated.

$$I_{x-x} = 2(A_1 d_1^2) + 2(A_2 d_2^2) + 2\left(\frac{bh^3}{12}\right) + 2(A_3 d_3^2) + 2(A_4 d_4^2) =$$

$$2(0.0598)(2.5)(2.9701)^2 + 2(0.0598)(1.0)(1.0)^2 + 2\left(\frac{(0.0598)(2.0)^3}{12}\right) +$$

$$2(0.1196)(2)^2 + 2(0.0224)(2.8125)^2 = 4.15 - \text{inch}^4.$$

To determine the percentage increase in load that stud with supplemental flanges can sustain, we next compute the moment of inertia about beammajor X-X axis of a standard steel beam (without the advantage of the supplemental flanges). Substituting the values as before, $$I_{x-x} = \left(\frac{bh^3}{12}\right)_{ss} + 2Ad_{ss}^2 + 2\left(\frac{bh^3}{12}\right)_{ss} + 2Ad_{ss}^2 =$$

$$\left(\frac{0.0598(6.0)^3}{12}\right) + 2(0.0598)(2.5)(3.0)^2 + 2\left(\frac{0.0598(0.375)^3}{12}\right) +$$

$$2(0.0598)(0.375)(2.8125)^2 = 3.23 - \text{inch}^4.$$

The percentage improvement in the beam with supplemental flanges is [(4.15−3.23)/(4.15)](100), or 22.3% stronger than an equivalent standard steel beam.

It has also been determined that resistance to local shear deflection of the beam is also enhanced for the slotted beam with supplemental flanges extending from the web at slot sides. That is, the beam with supplemental flanges also supports a greater lateral load, or a load placed intermediate a nonvertical beam directly on the web, on a slotted metal beam with supplemental flanges than on a metal beam without these features.

Though the beam is structurally enhanced by the supplemental flanges as discussed above, perhaps the most advantageous contribution of the supplemental flanges is that the web can be slotted without diminishing the structural integrity of the beam, and in fact providing an enhanced structure. The slots interrupt heat (and acoustical) flow through the web across the wall employing the beam. Prior to the described slotted beam with supplemental flanges, metal beams were disfavored because they are a poor insulator; in fact, they are a good conductor, defeating efforts for energy conservation and noise containment. Wood remained the preferred material because of the low conductivity of wood. For example, the "R" factor for wood (fir, pine, and spruce) for a 2"×6" stud is 361 K/w. [1 W/mK=0.578 BTU/Hr–ft–° F.]. The "R" factor for a steel same-sized slotted stud is 846 K/W. The rate of heat loss through the wood stud is 0.055 W and through the slotted steel stud is 0.024 K/W, or less than half. The steel stud immediately becomes competitive and even advantageous. In addition, instead of air in the slot, which conveys heat by convection, insulation can be added. The slotted beam enhanced structurally by the supplemental flanges and thermally by the slots and insulation in the slots thus becomes an attractive wall construction alternative. It is clear that the open slot left in the SFB that is created by the supplemental flange manufacturing process can vary in width and length depending on the requirements needed from the SFB. Changes in this width and length will affect the various geometric properties

DETAILED DESCRIPTION OF THE PREFERRED EMBODIMENTS

Figure 1:
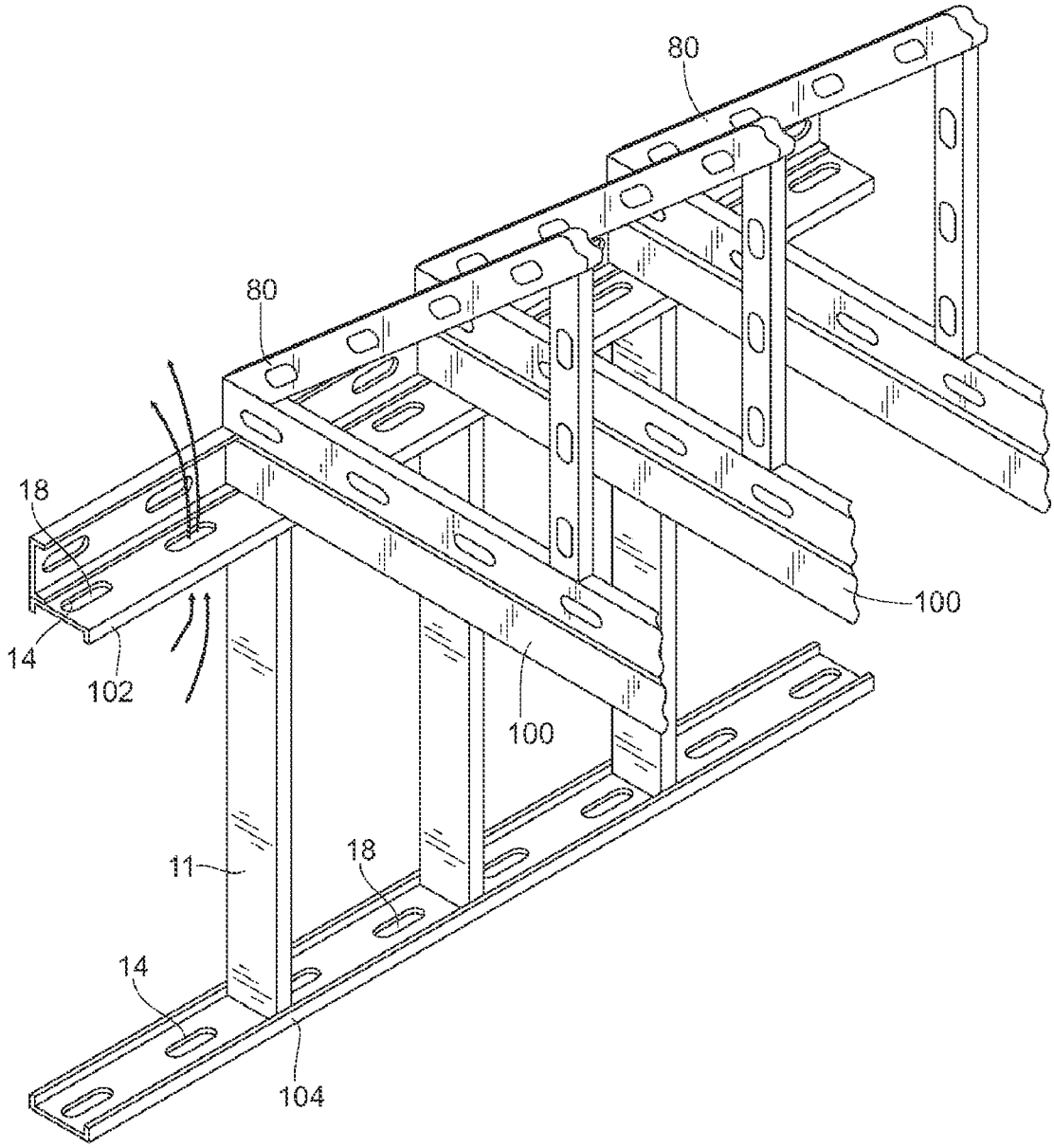
FIG. 1 is a perspective view of slots longitudinal in the web of joists and trusses and supplemental flanges extending from the slot sides, shown in a building structure.
Figure 2:
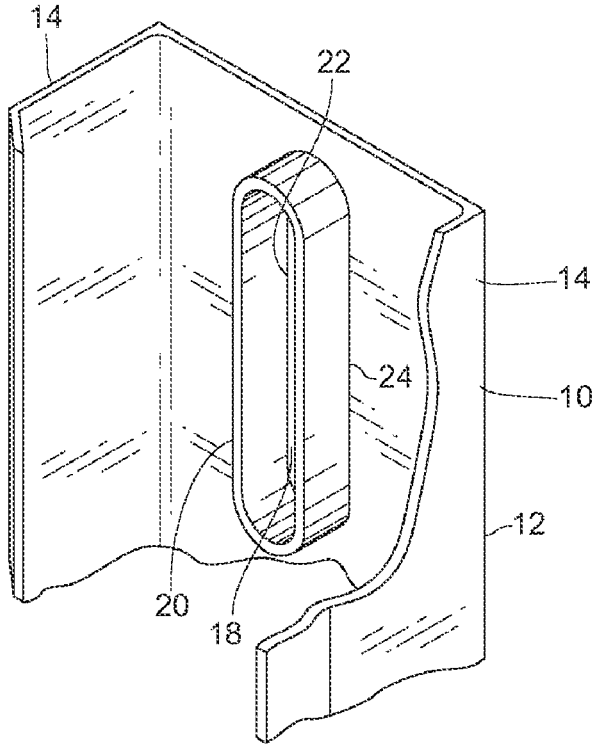
FIG. 2 is a front view of metal beam (stud, joist or truss component) with a web with a slot aligned vertically in the web with a supplemental flange continuous around the slot perimeter.
Figure 3:
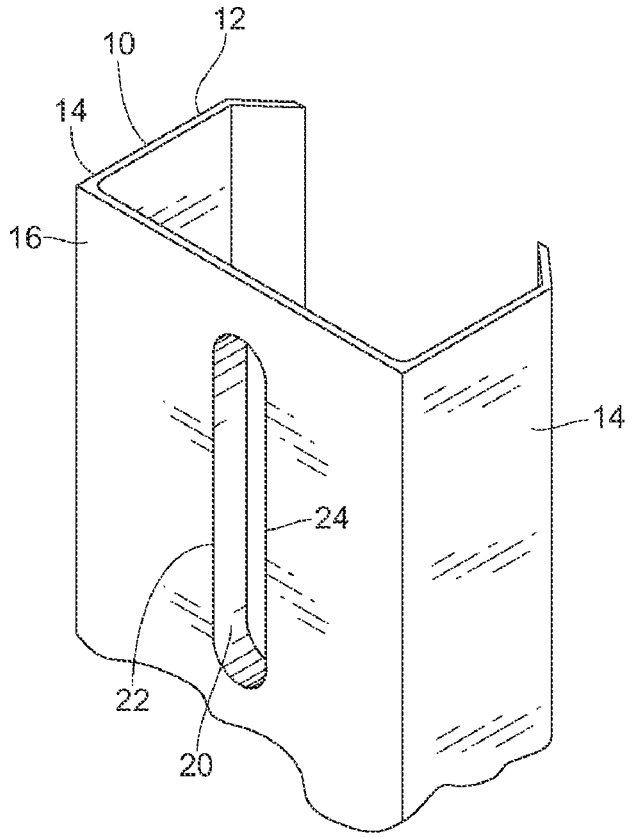
FIG. 3 is a back view of the beam of FIG. 2.
Figure 4:
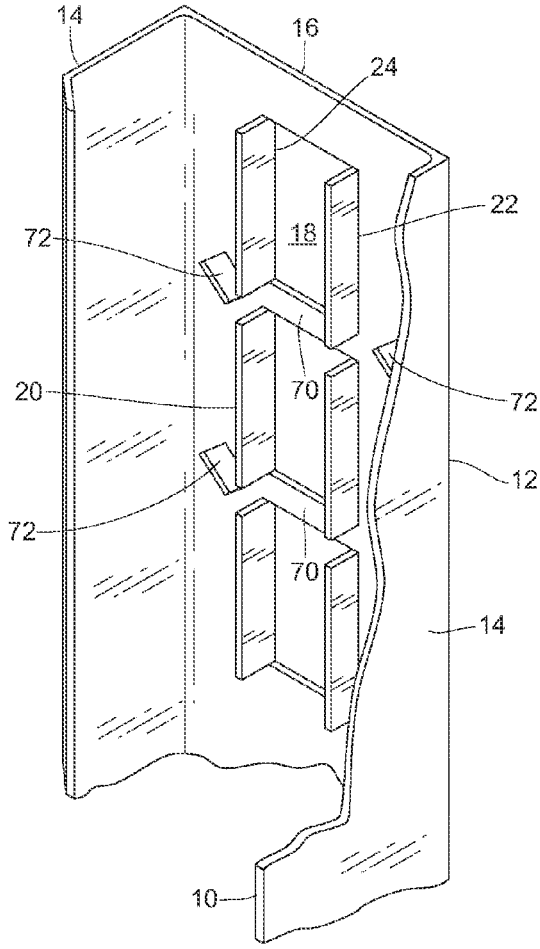
FIG. 4 is a front view of metal beam (stud, joist or truss component) with a web with a plurality of slots aligned vertically in the web with a supplemental flange extending from each slot side.
Figure 5:
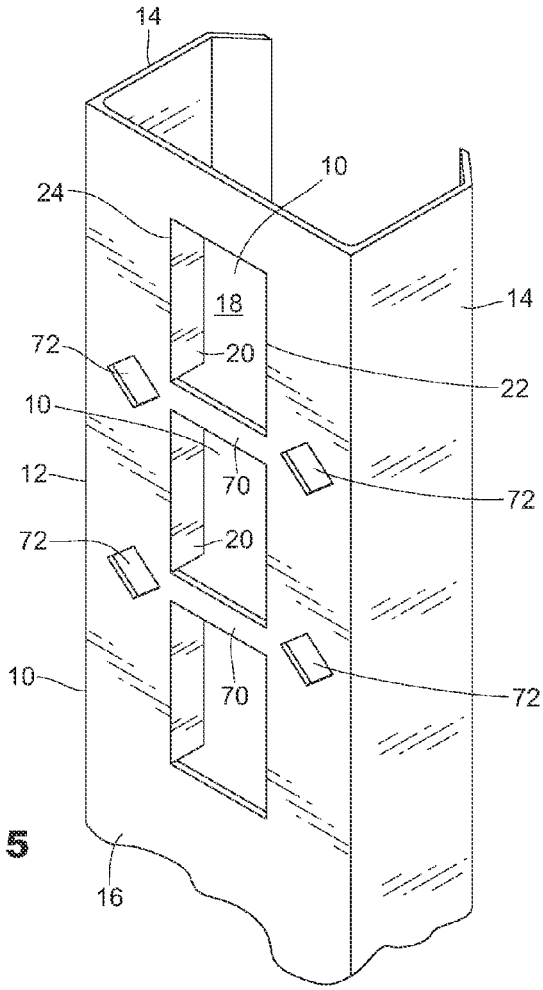
FIG. 5 is a back view of the beam of FIG. 4.
Figure 6:
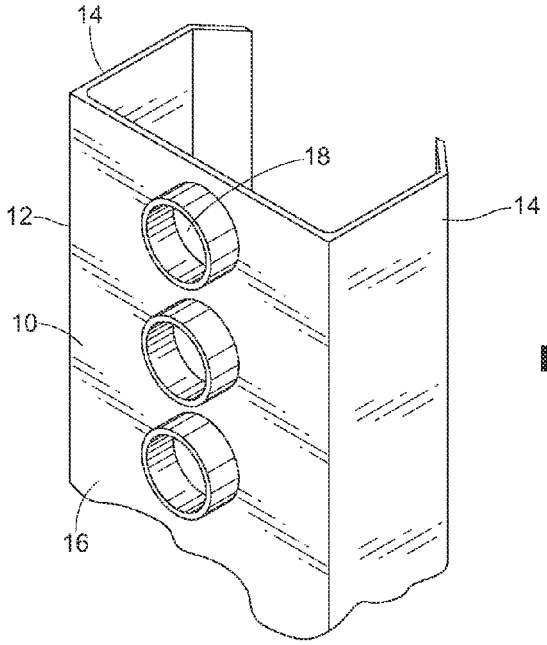
FIG. 6 is a rear perspective view of a beam showing a plurality of circular slots with supplemental flanges circumferential about the slots.
Figure 7:
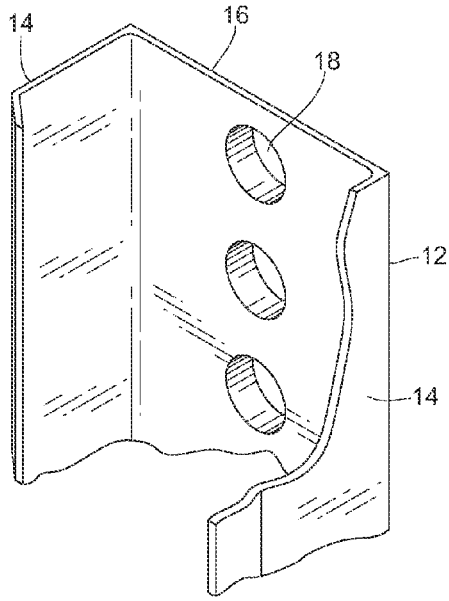
FIG. 7 is a front perspective view of the beam of FIG. 6.
Figure 8:
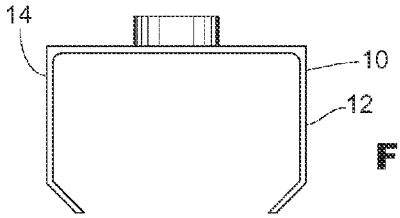
FIG. 8 is a top planar view of the beam of FIG. 6.

The slotted metal beam 10 is intended for use in conventional building construction, such as a stud in a wall, building joists and trusses. In the conventional manner of wall and building construction, a plurality of studs is spaced apart vertically in parallel between horizontal floor joists and ceiling joists 100. Typically, a channel stud header 102 connected to the ceiling joists 100 and opening downward receives upper ends 11 of the studs 10. Similarly, a channel stud footer 104 connected to the floor joists 100 and opening upward receives lower stud ends 13. Because the joists 100 are required to support a lateral, or transverse load, they may be larger and stronger than the studs 10, which support a compressive, or longitudinal load.

Figure 13:
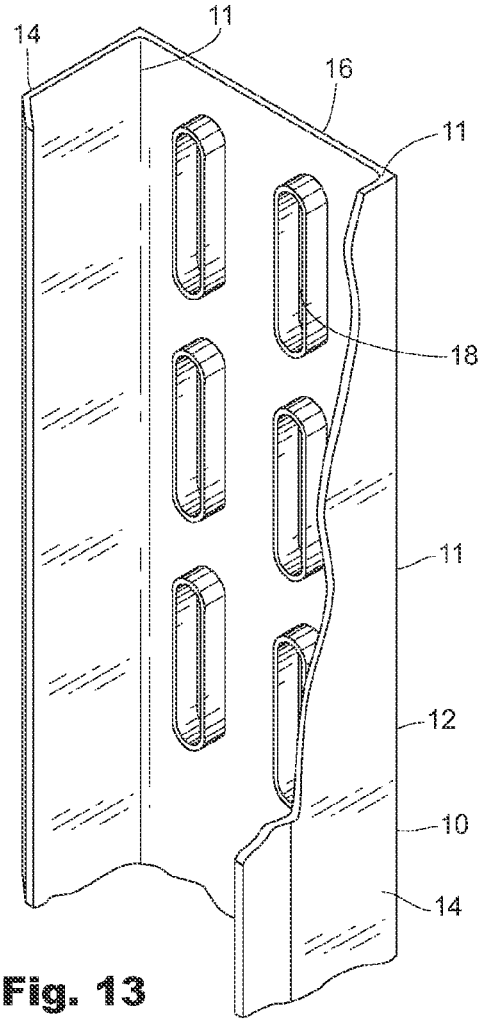
FIG. 13 is a rear perspective view of a beam showing a plurality of slots each with a supplemental flange continuous around the perimeter of each slot, the slots arrayed in two columns longitudinal in the web with a slot of one column adjacent a slot of the other columns.
Figure 14:
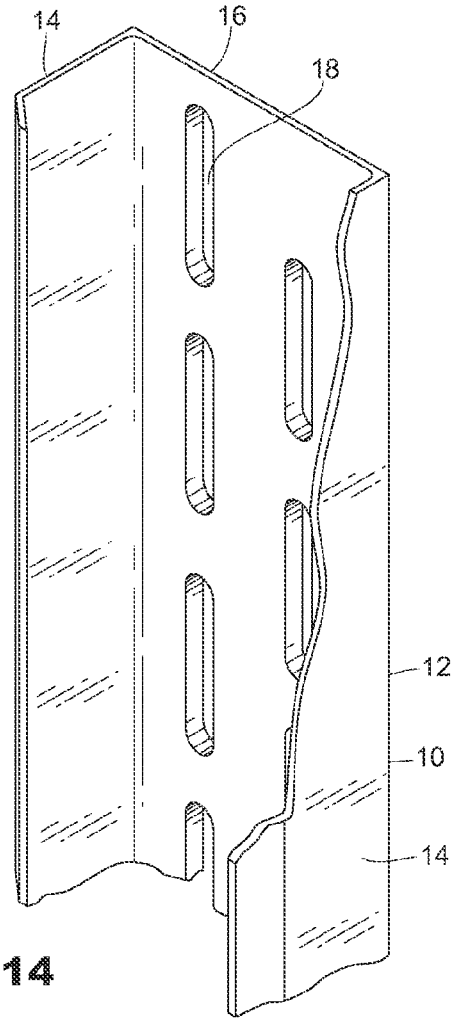
FIG. 14 is a rear perspective view of the beam of FIG. 13.
Figure 15:
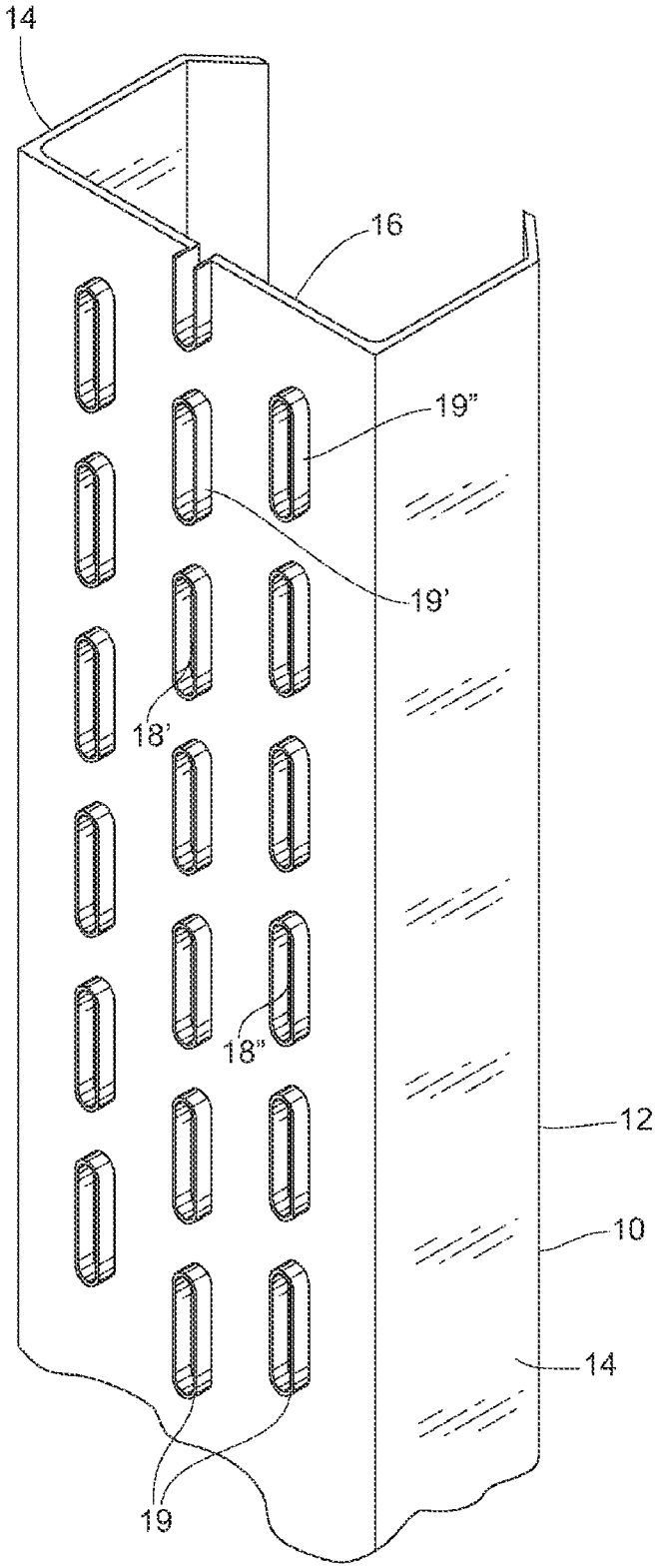
FIG. 15 is a perspective view of a metal beam shown with an array of slots, each slot having a supplemental flange continuous around the slot perimeter, the slots arranged in a plurality of columns longitudinal with the beam with slots of one column staggered from slots of an adjacent slot.

The beam 10 comprises a conventional C-shaped channel 12 including a pair of parallel primary flanges 14 extending a same extent orthogonally from and separated by a web 16. In the preferred embodiment, at least one and preferably a plurality of slots 18 are stamped in the web 16 such that at least one and preferably two supplemental flanges 20 bend out of the slot 18 from first and second slot sides 22, 23 bounding the slot 18 to extend inward, between and parallel to the primary flanges 14. In this manner, the supplemental flanges 14 comprise a substantial areal portion, and typically a third, of the web 16 bending from the web to form the slot. The slots 18 may be arrayed in one or more columns 19. Two or more columns 19 may be configured with slots 18 side by side in adjacent slot columns as shown in FIGS. 13, 14, and 15 or with slots 18' of one column 19' staggered between or overlapping slots 18" of an adjacent column 19".

Preferably, the supplemental flanges 20 are similar, symmetrically extending inward from the web 16 from said slot sides 22, 24. Thus, each supplemental flange 20 will be in length between its proximal end at the web to its distal end a distance equal to half of the width of the slot 18. (In a minor variation, the web 16 is stamped to form a slot 18 with a single supplemental flange 20' that bends inward from a slot side 22, 24, in which case the length of the supplemental flange 20' is the width of the slot 18.) Though the supplemental flange preferably extends orthogonally from the web, it can also extend from the web at any angle other than perpendicular to the web, as shown in FIG. 26.

Figure 12:
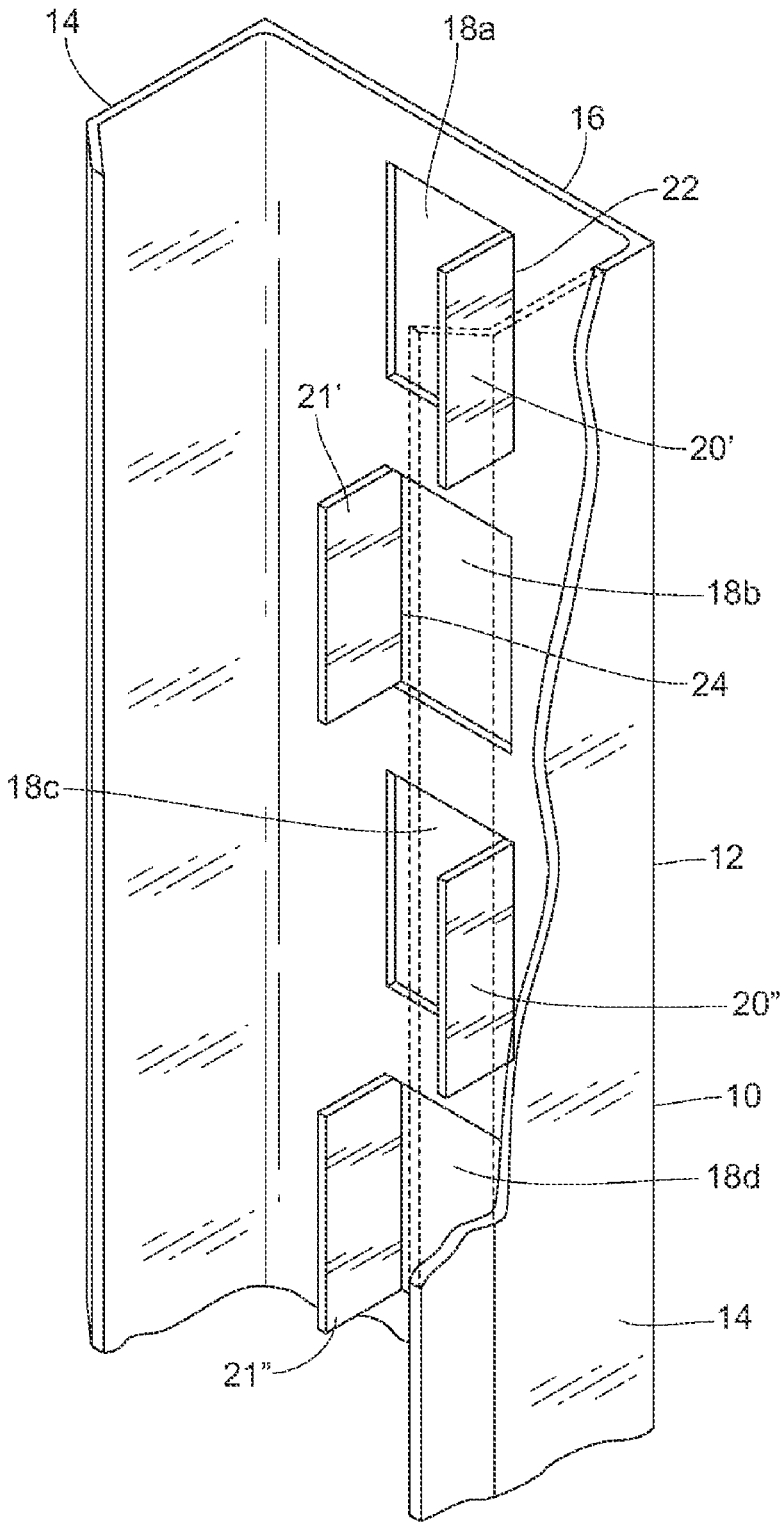
FIG. 12 is a front perspective view of beam showing a plurality of slots with a supplemental flange extending from a first side of a slot and from the other side of a next adjacent slot.

Typically, the supplemental flanges 20 comprise a major portion, and even most of the web 16 bending inward between the primary flanges 14 forming the slot 18 and the supplemental flanges 20 therein substantially moving the beam 10 cross sectional center of gravity away from the web 16 therein substantially transferring load support from the web 16 to the primary flanges 14. In the preferred embodiment shown in FIG. 12, a supplemental flange 20 extends from each side 22, 24 of a plurality of slots 18 aligned vertically in the web 16 maintaining symmetry in the beam 10 for uniform load support through the beam 10. In an alternative embodiment, a first supplemental flange 20' extends from the web 16 at a first slot side 22 of a first slot 18*a*, a second supplemental flange 21' extends inward from the web 16 at a second slot side 24 of a second slot 18*b*, the second slot 18*b* being adjacent said first slot 18*a*, a third supplemental flange 20" extends from the web at the first slot side 22 of a third slot 18*c*, the third slot 18*c* being adjacent the second slot 18*b*, and a fourth supplemental flange 21" extends inward from the web 16 at the second slot side 22 of a fourth slot 18*d* adjacent the third slot 18*c*, the fourth slot 18*d* being adjacent the third slot 18*c* such that the supplemental flanges 20', 21', 20", 21" for successive adjacent slots alternate between extension from first and second slot sides 22, 24. The alternating pattern continues through the web 16 such that there are the same number of supplemental flanges 20, 21 on each of the slots' first and second sides 22, 24. Thus configured, the supplemental flanges 20, which are all similar and all between the primary flanges 14, extend further away from the web 16, therein further moving the beam cross sectional center of gravity away from the web 16 more effectively transferring load support from the web 16 to the primary flanges 14.

Although the preferred embodiment is for the supplemental flanges 20 to extend inward such that the beam center of gravity is moved inward the beam and away from the web 16, thereby transferring more of the beam support from the web 16 and onto the primary flanges 14, the supplemental flanges 20 may also bend outward, away from the beam 10. As discussed, there is a structural advantage to moving the center of gravity inward in that the load on the beam is better distributed to the flanges instead of mostly on the web. Similarly, there is also a structural advantage in having the supplementary flanges 20 outward from the web. As given above the primary component in the beam moment of inertia of primary consequence is the term, $I=b\ h^3/12$ where b is the beam base (web dimensional direction), and h is the height (flange directional direction). It is seen that increasing the height even a small amount dramatically increases the beam strength. Thus for a beam beginning with a 2-inch flange and increasing it by 2 inches by extending a supplemental flange outward from the web, the beam strength increases by a factor of $4^3/2^3$, or 64/8=8. It may also be advantageous for some supplemental flanges to bend inward and some outward.

Figure 9:
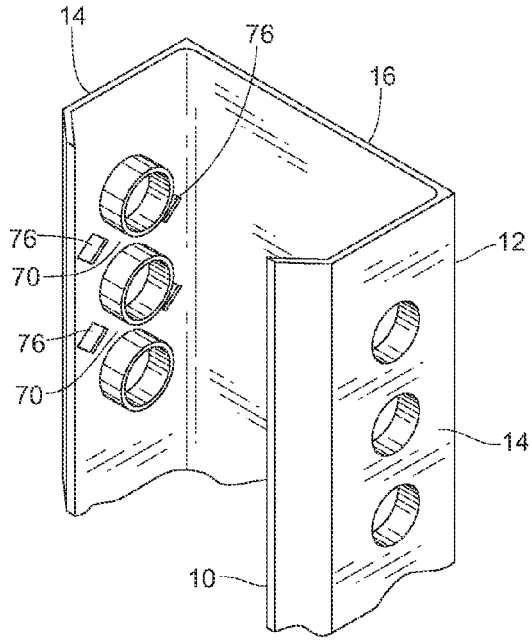
FIG. 9 is a rear perspective view of a beam with a slotted web having supplemental flanges extending inward from primary flanges.
Figure 10:
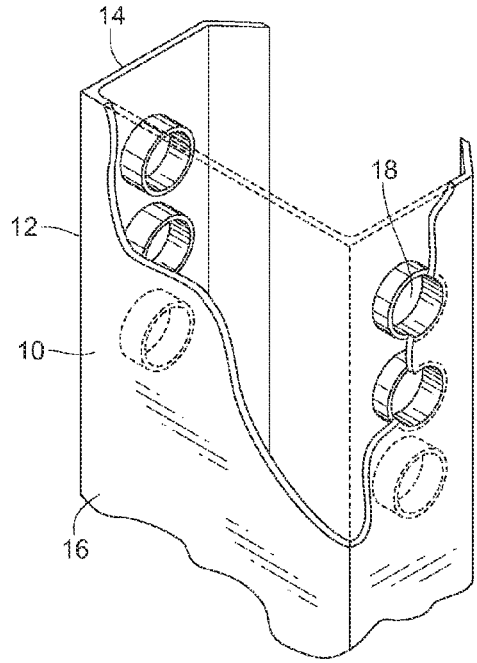
FIG. 10 is a front perspective view of a beam of FIG. 9.
Figure 11:
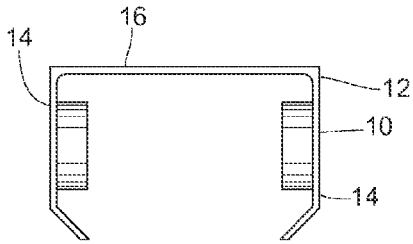
FIG. 11 is a top planar view of the metal beam of FIG. 9.

In one of the embodiments, the slot is rectangular and supplemental flanges 20 extend from the slot 18 either vertically, parallel with the primary flanges, or horizontal, orthogonally to the primary flanges 14. However, other variations in slot shape are deemed included in the invention. For example, the slot ends (top and/or bottom) may be of triangular shape each with two supplemental flanges bent and extending from the legs of the. Similarly, the slot top and/or bottom may be curvilinear, such as a semicircle, with a plurality of relatively small supplemental flanges extending from the slot ends. Alternatively, the slot may be punched out from its center to produce a continuous and uninterrupted supplemental flange around an oval. In a further embodiment, the beam (stud, or truss, etc.) 10 may comprise one or more slots 18 in one or both primary flanges 14 with one or more supplemental flanges 20 extending into the beam 10 as shown in FIG. 9-11. The illustration shows a circular supplemental flange 20, representative of the various alternative configurations of flanges extending from a slot in a primary flange as described above for web based supplemental flanges, all of which are deemed included in this invention.

With the supplemental flanges 20 formed out of the web 16 from web material removed and folded from the web 14 to form the slots 18, the amount of beam material remains unchanged from a traditional metal beam. Thus, the dimensions of the supplemental flanges in the various configurations described above are defined by the dimensions of the slot from which it bends. That is, two supplemental flanges extending from the two slot sides may each be half the width of the slot. If there are flanges extending from respective ends of a rectangular slot, the side supplemental flanges are reduced in length equal to the sum of the extent of the top and bottom supplemental flanges. In maintaining the same amount of material in the beam, the beam does not reduce in support strength but in fact increases in support strength as calculated above.

A pair of slots 10 in the web 16 are separated by a bridge 70. The insulation properties of the beam 10 are improved with a bridge hole 72 in the web 16 outside of the slots 10 on respective bridge ends 74, precluding a straight heat path across the bridge 70 between web sides 11. A similar bridge hole 72 is advantageous at the top or bottom, or both top and bottom, of the beam respectively above and below the slot. The bridge hole 72 is advantageously diamond shape for structural enhancement with diamond diagonals horizontal and vertical, typically. A supplemental hole 76 similar to the bridge hole 72 is advantageously placed in the supplemental flange 20, which reduces the weight of the beam without losing beam structural integrity. (The term "bridge" refers generally to a bridge between two longitudinally slots and likewise the "bridge hole" refers generally to a hole at one or more bridge ends, all of which may be located in fact in the web, a primary flange, or a supplemental flange.)

It is to be understood that the beams described hereinabove as beams are in fact straight building components that can be employed in other building capacities, such as joists and as beams of a truss 80. The figures provide a number of examples of trusses but that are provided as illustrative only of the many configurations that can be designed from a plurality of beams.

A truss 80 is constructed from a plurality of beams 10. For purposes herein, the truss 80 includes any and all structural frames based on the geometric rigidity of the triangle and comprising beams subject to longitudinal compression, tension, or both and so configured to make the frame rigid under loads.

Several figures have been provided as illustrative of various embodiments of the invention. The figures are for illustrative purposes only and not as limitations of the invention. A feature illustrated on one figure can be implemented in another configuration or in combination with another configuration. For example, an array of circular slots are deemed to include all possible shapes of slots in an array configuration and not limited to circular slots. Similarly, a figure may show a slot shape with a supplemental flange extending inward from the web or a primary flange and another slot shape or supplemental flange in the same or an alternative configuration extending outward from the web. It should be understood that any slot or supplemental flange shape may be configured to extend inward or outward or in any configuration represented as a feature in another figure by another shape.

Figure 16:
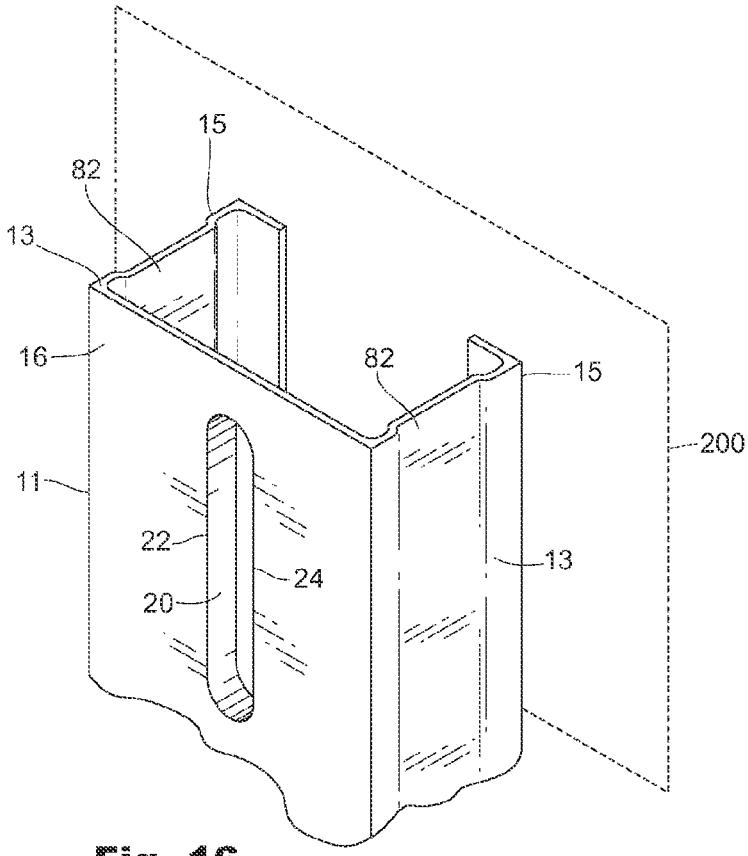
FIG. 16 is a perspective view of the beam of FIG. 3 with primary flanges inset from bridge sides.
Figure 17:
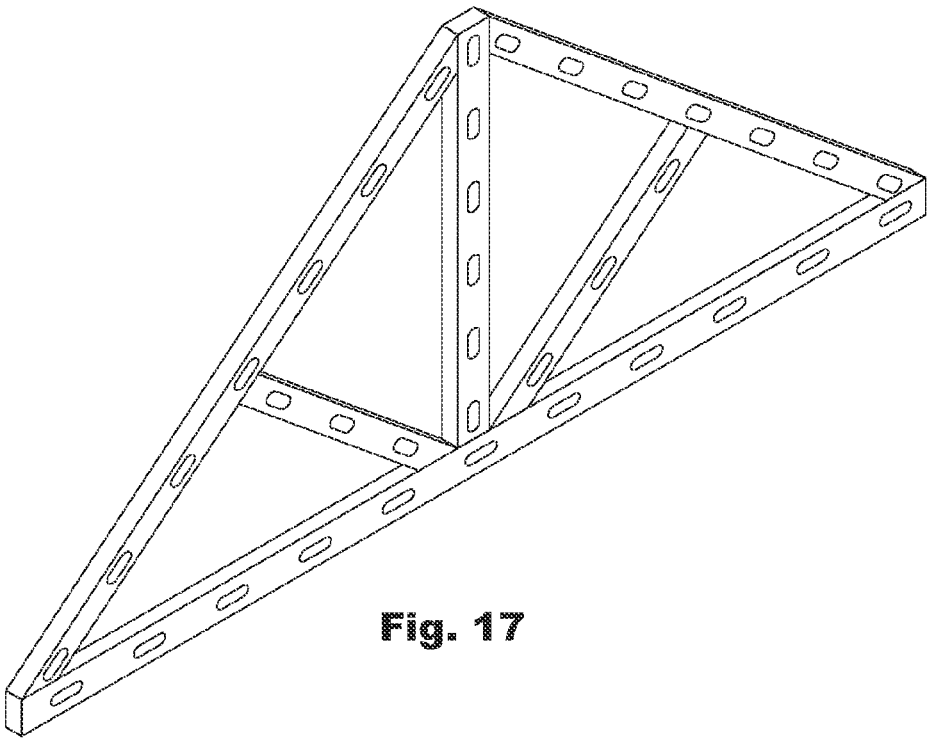
FIG. 17 is a perspective view of a truss comprising a plurality of slotted beams with supplemental flanges.
Figure 18:
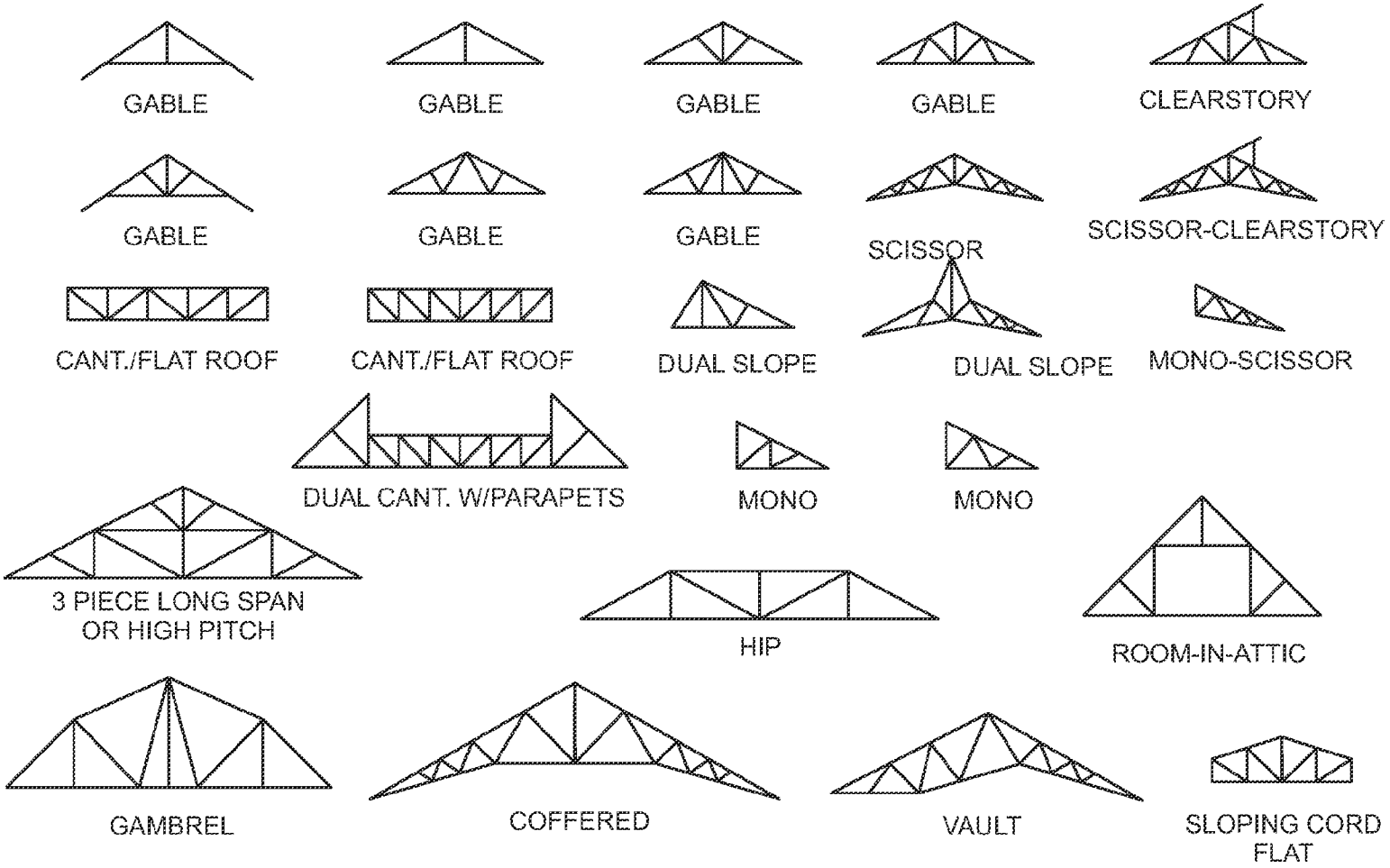
Fig. 18 (PRIOR ART)
FIG. 18 is a plan view of many truss configurations existing in the prior art.

In another embodiment the beam primary flanges 14 bend inward from web sides 11 and then bend again away from the web such that the primary flanges are offset inward from web sides 11. The primary flanges then bend outward at primary flange ends 15 to a plane 200 orthogonal to respective web sides 11 providing a gap 82 between each primary flange 14 and the respective plane 200 as shown in FIG. 16. Thus, when a planar panel (not shown) is installed against a beam side 13, air gap 82 is created between the panel and the primary flange 14 with the only contact with the beam being between web sides 11 and the end of the primary flange 15, thus reducing heat transfer from the panel to the beam 10. Advantageously the gap 82 may also be filled with insulation to further reduce heat transfer.

Having described the invention, what is claimed is as follows:

1. A building structure comprising a plurality of beams as horizontal parallel joists and a plurality of vertical parallel studs disposed orthogonal to the joists, at least one of the joists comprising primary flanges extending from sides of a web, the improvement comprising said web of said stud with a slot intermediate the web and at least two supplemental flanges extending respectively from at least two sides of said slot, the at least two supplemental flanges together comprising a portion of the web separated and bent away from the web on said at least two sides of said slot with the portion of the web removed by bending the supplemental flanges out of the web resulting in an opening in the web, which opening forms the whole or substantially the whole of said slot and wherein the at least two supplemental flanges comprise a first and a second supplemental flange extending from respective first and second sides of said slot that are longitudinal with the joist and parallel to the primary flanges and wherein said first and second supplemental flanges are unconnected except by the web and the slot, and spaced apart on opposite sides of the slot.

2. The building structure of claim 1 wherein the primary flanges and web are symmetrical about a transverse line of symmetry parallel to the primary flanges and the first and second supplemental flanges are symmetrical in the web about said transverse line of symmetry such that a cross sectional center of gravity for the slotted beam with said supplemental flanges on the transverse line of symmetry is a distance from the web greater than that of a beam without supplemental flanges and a slotted web, thereby partially transferring compressive load support longitudinal on the beam from the web to the primary flanges.

3. The building structure of claim 1 further comprising a plurality of slots each with said supplementary flanges.

4. A building joist as a beam designed and adapted to be horizontal in supporting a load, comprising first and second primary flanges separated by and extending from a web, the improvement comprising said web of said stud with a slot intermediate the web and at least two supplemental flanges extending respectively from at least two sides of said slot, said at least two supplemental flanges together comprising a portion of the web separated and bent away from the web on said at least two sides of said slot with the portion of the web removed by bending the supplemental flanges out of the web resulting in an opening in the web, which opening forms the whole or substantially the whole of said first slot and wherein the at least two supplemental flanges comprise a first and a second supplemental flange extending from respective first and second sides of said slot that are longitudinal with the joist and parallel to the primary flanges and wherein said first and second supplemental flanges are unconnected except by the web and the slot, and spaced apart on opposite sides of the slot.

5. The building joist of claim 4 further comprising top and bottom supplemental flanges extending from slot top and bottom sides, the supplemental flanges comprising a portion of the web separated and bent away from the web resulting in an opening in the web which opening forms the whole or substantially the whole of said first slot.

6. The building joist of claim 5 wherein at least one of the supplemental flanges extends outward from the web and away from the first and second primary flanges.

7. The building joist of claim 5 wherein at least one of said supplemental flanges extends from the web at an angle other than orthogonal.

8. The building joist of claim 4 wherein the slot comprises a plurality of said slots longitudinal in the web, each with said at least two supplementary flanges.

9. The building joist of claim 4 wherein said primary flanges bend inward from web sides and then bend again away from the web such that the primary flanges are inward from web sides.

10. The building joist of claim 9 wherein said primary flanges bend outward at primary flange ends to a plane orthogonal to respective web sides providing a gap between each primary flange and respective plane.

11. A truss comprising at least three beams interconnected in a configuration at least a portion of which forms at least one triangular unit, at least one of said beams comprising a web and first and second primary flanges extending from the web, the improvement comprising said web of said beam with a slot intermediate the web and at least two supplemental flanges extending respectively from at least two sides of said slot, the at least two supplemental flanges together comprising a portion of the web separated and bent away from the web on said at least two sides of said slot with the portion of the web removed by bending the supplemental flanges out of the web resulting in an opening in the web, which opening forms the whole or substantially the whole of said first slot, and wherein the at least two supplemental flanges comprise a first and a second supplemental flange extending from respective first and second sides of said slot that are longitudinal with the joist and parallel to the primary flanges and wherein said first and second supplemental flanges are unconnected except by the web and the slot, and spaced apart on opposite sides of the slot.

12. The building structure of claim 1 further comprising a plurality of roof trusses wherein at least one of said trusses has a horizontal member above and orthogonal to the vertical studs, the truss horizontal member comprising the horizontal parallel joist, and wherein at least one of the vertical studs and the truss also comprises parallel first and second primary flanges separated by and extending from a web, the web having at least one slot and at least two supplemental flanges extending respectively from at least two sides of said slot, the at least two supplemental flanges together comprising a portion of the web separated and bent away from the web on said at least two sides of said slot with the portion of the web removed by bending the supplemental flanges out of the web resulting in an opening in the web, which opening forms the whole or substantially the whole of said first slot, and wherein the at least two supplemental flanges comprise a first and a second supplemental flange extending from respective first and second sides of said slot that are longitudinal with the joist and parallel to the primary flanges and wherein said first and second supplemental flanges are unconnected and spaced apart on opposite sides of the slot.

13. The building structure of claim 1 wherein said at least one of (a) a said vertical stud beam, and (b) a said joist comprises two longitudinally adjacent slots divided by a bridge and includes a bridge hole substantially outside of the slots laterally on either or both bridge ends.

* * * * *